US009915022B2

(12) United States Patent
Cozzolino et al.

(10) Patent No.: US 9,915,022 B2
(45) Date of Patent: Mar. 13, 2018

(54) HOUSEHOLD LAUNDRY-DRYING MACHINE

(71) Applicant: INDESIT COMPANY S.P.A., Fabriano (IT)

(72) Inventors: Anna Cozzolino, Fabriano (IT); Sandra Marinozzi, Fabriano (IT); Roberto Tarabu, Fabriano (IT)

(73) Assignee: Indesit Company S.P.A., Fabriano (IT)

( * ) Notice: Subject to any disclaimer, the term of this patent is extended or adjusted under 35 U.S.C. 154(b) by 0 days.

(21) Appl. No.: 15/271,531

(22) Filed: Sep. 21, 2016

(65) Prior Publication Data

US 2017/0089002 A1 Mar. 30, 2017

(30) Foreign Application Priority Data

Sep. 28, 2015 (EP) ..... 151871753

(51) Int. Cl.
*D06F 58/20* (2006.01)
*D06F 58/04* (2006.01)

(52) U.S. Cl.
CPC ..... *D06F 58/203* (2013.01); *D06F 58/04* (2013.01)

(58) Field of Classification Search
CPC ..... D06F 58/203; D06F 58/04; D06F 58/22; F28D 9/0037; F28F 9/001
USPC ..... 34/60, 595–610; 68/19, 20
See application file for complete search history.

(56) References Cited

U.S. PATENT DOCUMENTS 3,670,425 A * 6/1972 Benjamin ..... D06F 73/02 223/51
4,254,139 A 3/1981 Hendrickson et al.
6,883,723 B2 * 4/2005 Griese ..... A47L 15/44 206/5
7,441,345 B2 * 10/2008 Taylor ..... D06F 58/203 34/406

(Continued)

FOREIGN PATENT DOCUMENTS

DE 102005034418 A1 1/2007
EP 1495178 B1 1/2005

(Continued)

OTHER PUBLICATIONS

Whirlpool Dryer blower wheel for model LER4634 from whirlpoolparts.com dated Aug. 2017.*

(Continued)

*Primary Examiner* — Stephen M Gravini

(57) ABSTRACT

A household laundry-drying machine comprising a drum rotatable about an axis of rotation and defining a laundry drying compartment, said drum comprising a substantially cylindrical peripheral wall which surrounds the laundry drying compartment, at least one laundry-agitation member associated to the cylindrical peripheral wall and protruding internally to the laundry drying compartment, an air heater for drying the laundry, and a conduit for conveying the air from the air heating means to the laundry drying compartment.

The laundry-agitation member comprises a cavity in fluid communication with the laundry drying compartment, said cavity being suitable for containing at least one substance to be delivered in the laundry drying compartment during a drying cycle. The cavity of the laundry-agitation member is external to said means for conveying the air.

13 Claims, 3 Drawing Sheets

(56) References Cited

U.S. PATENT DOCUMENTS

| | | | | |
|---|---|---|---|---|
| 7,980,001 | B2 * | 7/2011 | Trinh | C11D 3/001 206/5 |
| 9,435,064 | B2 * | 9/2016 | Kim | D06F 58/04 |
| 2005/0192206 | A1 * | 9/2005 | O'Brien | C11D 3/001 510/520 |
| 2007/0271966 | A1 | 11/2007 | O'Brien et al. | |
| 2013/0139404 | A1 | 6/2013 | Stegerwald | |
| 2017/0089002 | A1 * | 3/2017 | Cozzolino | D06F 58/04 |

FOREIGN PATENT DOCUMENTS

| | | | | |
|---|---|---|---|---|
| EP | 2410086 | A1 | 1/2012 | |
| EP | 2636356 | A1 | 9/2013 | |
| EP | 3147403 | A1 * | 3/2017 | D06F 58/203 |
| KR | 100712271 | B1 | 4/2007 | |
| WO | WO 2013131997 | A1 * | 9/2013 | A47L 15/44 |

OTHER PUBLICATIONS

European Search Report for Counterpart EP15187175.3, dated Mar. 3, 2016.

* cited by examiner

HOUSEHOLD LAUNDRY-DRYING MACHINE

CROSS REFERENCE TO RELATED APPLICATIONS

This application claims the benefit of European Patent Application No. 151871753, filed Sep. 28, 2015, which is incorporated herein by reference in its entirety.

BACKGROUND OF THE INVENTION

The present invention relates to a household laundry-drying machine.

Laundry-drying machines comprise a cabinet and a rotatable drum housed in the cabinet. The front of the drum is accessible via a door hinged to the front wall of the cabinet for loading and unloading of the laundry to be dried. The drum comprises also laundry agitation members connected to the peripheral wall of the drum itself.

The drying machines comprise also:

- an air heater (usually an electrical resistance) for drying the laundry.
- a conduit for conveying the air from the air heater to the drum, (for example one duct and one fan). The heated air dries the laundry. In fact in the drum the heated air is saturated by the humidity yielded by the laundry and then it exits from the drum.

EP2410086 discloses a scent agent dispenser adapted to be placed into a rotary drum of a machine for treating laundry, in particular a washing or washing/drying machine. The dispenser is a ball comprising a casing which defines a cavity that houses at least one absorbing element adapted to be imbibed with a liquid scent agent, and comprising one or more holes in the casing through which the scent agent is put in contact with the outside of the cavity. However the use of an additional ball, introduced in the drum during the drying cycle, generates noise (in fact the ball can move freely in the drum). In this context, the technical task that is at the basis of the present invention is to propose an improved machine and method for drying laundry. In particular, one object of the present invention is sanitizing laundry and/or eliminating bad odors (if any). Another object of the present invention is reducing wrinkles in the dried articles.

The technical task sets and the objects specified are substantially attained by a machine and a method comprising the technical characteristics as set out in one or more of the accompanying claims.

SUMMARY OF THE INVENTION

In one aspect, the current description relates to a household laundry-drying machine comprising a drum rotatable about an axis of rotation and defining a laundry drying compartment, the drum having a peripheral wall which surrounds the laundry drying compartment, an air heater, a fan forcing air from the air heater to the laundry drying compartment, and a laundry-agitation member provided on the peripheral wall and comprising a cavity in fluid communication with the laundry drying compartment.

Another aspect of the current description is a method for drying laundry in a household laundry-drying machine comprising a drum having a laundry-agitation member, the method comprising dispensing into the drum at least one substance, from a cavity in the laundry-agitation member.

BRIEF DESCRIPTION OF THE DRAWINGS

Further features and advantages of the present invention will become clearer from the indicative and thus non-limiting description of a preferred but non-exclusive embodiment of a machine, as illustrated in the attached drawings, in which.

DETAILED DESCRIPTION OF EMBODIMENTS OF THE INVENTION

Figure 1:
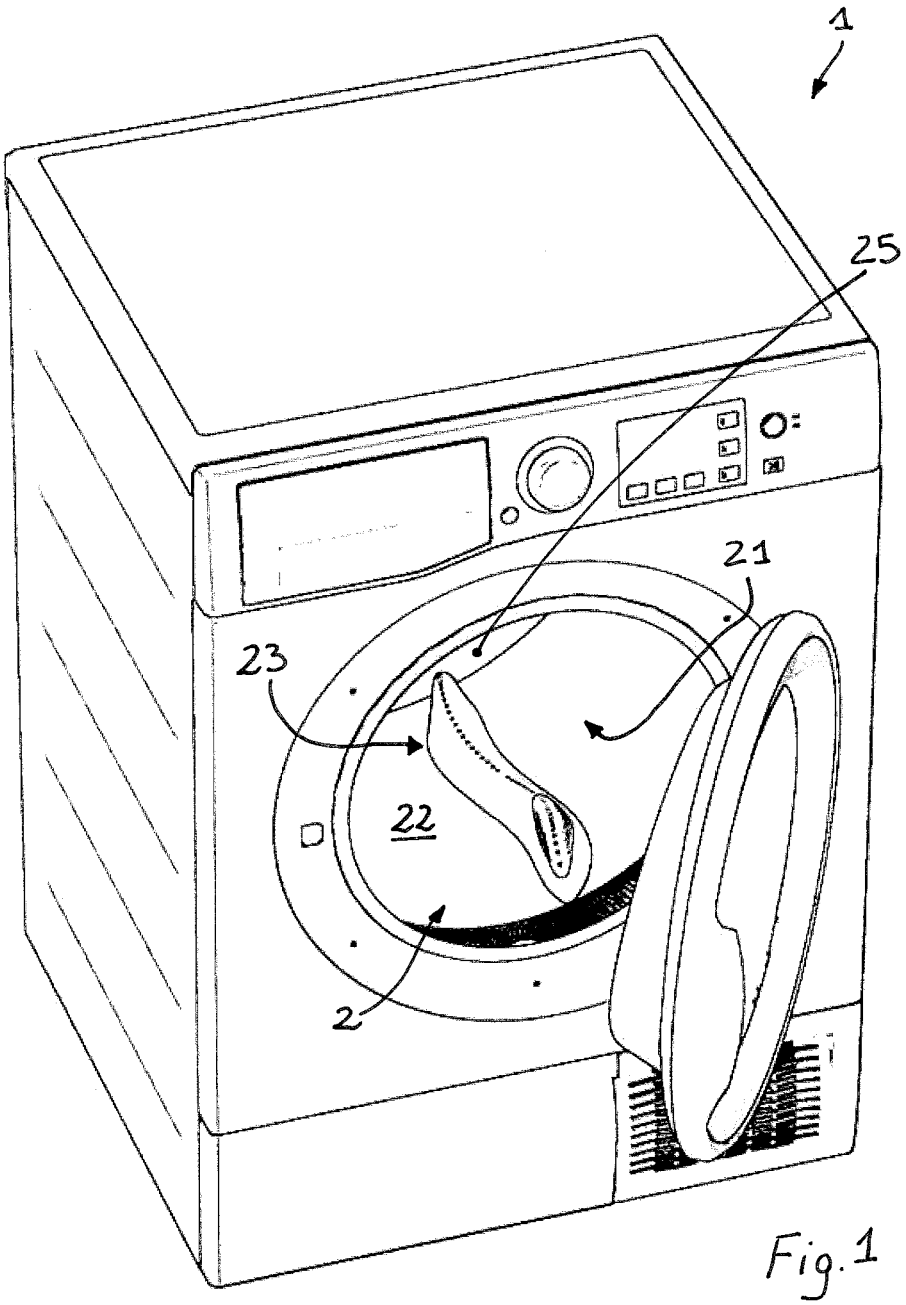
FIG. 1 is a perspective view of a laundry-drying machine according to the present invention.

In the accompanying figures, reference number 1 indicates a household laundry-drying machine. In the described embodiment the laundry-drying machine is unsuitable for washing laundry. Advantageously the dryer is a heat pump dryer or a condensing dryer.

The household laundry-drying machine comprises a drum 2 rotatable about an axis of rotation 20. The drum 2 defines a laundry drying compartment 21 for the laundry to be dried. The drum 2 comprises also a substantially cylindrical peripheral wall 22, which surrounds the laundry drying compartment 21. The drying compartment 21 is internal to the drum 2.

The drum 2 advantageously comprises a front wall and a rear wall 25. The front wall and the rear wall 25 are reciprocally opposed. On the front wall there is an aperture for permitting the introduction of the laundry. The substantially cylindrical peripheral wall 22 develops in width between the front wall and the rear wall 25.

The drum 2 comprises also at least one laundry-agitation member 23 associated to the cylindrical peripheral wall 22. Said laundry-agitation member 23 protrudes internally to the laundry drying compartment 21. The laundry-agitation member 23 preferably develops in length for at least two thirds of the width of the substantially cylindrical peripheral wall 22.

The laundry-agitation member 23 is a lifter (it is also known in the art as "paddle").

Advantageously the drum 2 comprises a plurality of laundry agitation members 23. Preferably the laundry agitation members 23 are identical to one another.

Figure 4:
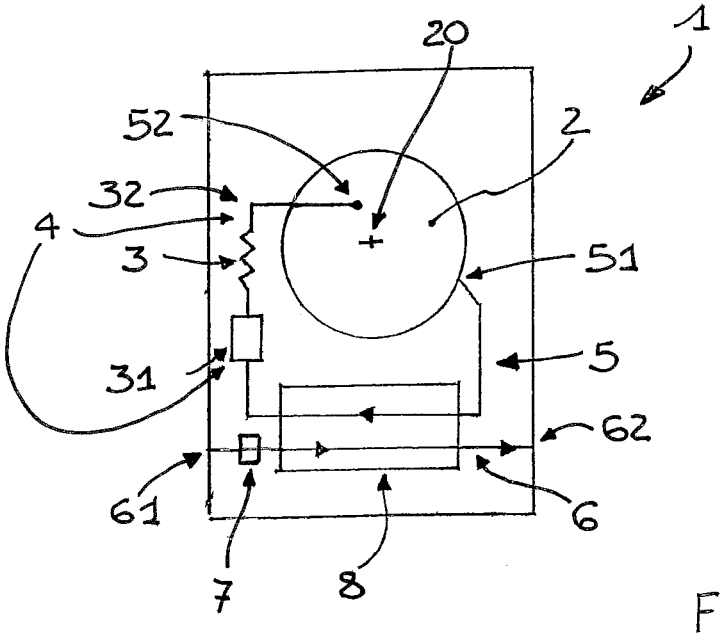
FIG. 4 is a schematic view of a laundry-drying machine that may comprise the features of the present invention.

As shown in FIG. 4, the household laundry-drying machine 1 comprises also air heater 3. The air heater 3 heats the air used for drying the laundry. The air heater 3 may comprise but is not limited to an electric resistance.

The household laundry-drying machine 1 comprises also a conduit 4 for conveying the air from the air heater 3 to the laundry drying compartment 21.

The conduit 4 for conveying the air from the air heater 3 to the laundry drying compartment 21 comprises at least one duct 32 and one fan 31 for forcing the air into the drum 2. The rear wall 25 of the drum 2 also comprises a drying air inlet (not shown) for the drying air, said inlet comprising an array of holes.

The duct 32 is part of a first channel 5 which comprises an inlet 51 of a fluid (moist air) present in the laundry drying compartment 21 and an outlet 52 for re-introducing said fluid into the laundry drying compartment 21; the fan 31 sucks the fluid present in the laundry drying compartment 21 and re-introduces said fluid into the laundry drying compartment 21.

The household laundry-drying machine 1 could also comprise: a second channel 6, which further comprises a cooling air inlet 61 from the outside of the household laundry-drying machine 1 and an air outlet 62 to the outside of the household laundry-drying machine 1.

The household laundry-drying machine also comprises a fan 7 to suck and move air into the second channel 6. It is worthwhile to note that 7 may also include but not be limited to a pump.

The household laundry-drying machine also comprises a heat exchanger 8 which puts into thermal communication at least one stretch of the first channel 5 and a stretch of the second channel 6 and in which the cooling air takes heat away from the fluid traveling through the first channel 5.

The laundry-agitation member 23 comprises a cavity 230 in fluid communication with the laundry drying compartment 21.

The cavity 230 is suitable for containing at least one substance to be delivered in the laundry drying compartment 21 during a drying cycle. The cavity 230 could be a reservoir.

The substance may be sold with the household laundry-drying machine 1 or independently as a standalone product. The substance could be water (possibly with some additives) which is heated for the generation of steam. The substance in the cavity 230 may comprise a liquid or a solid body. The liquid could also be contained in an external envelope which could be designed to melt with exposure to heat.

The cavity 230 of the laundry-agitation member 23 is external to the conduit 4 for conveying the air. So all the drying air during the movement from the air heating means 3 to the laundry drying compartment 21 do not pass through the cavity 230.

The cavity 230 is in fluid communication with the outside of the drum 2 only through the laundry drying compartment 21.

In view of the above the cavity 230 in fluid communication with the laundry drying compartment 21 is used for dispensing the substance for the treatment of the laundry.

The laundry-agitation member 23 is completely made of plastic.

Figure 2:
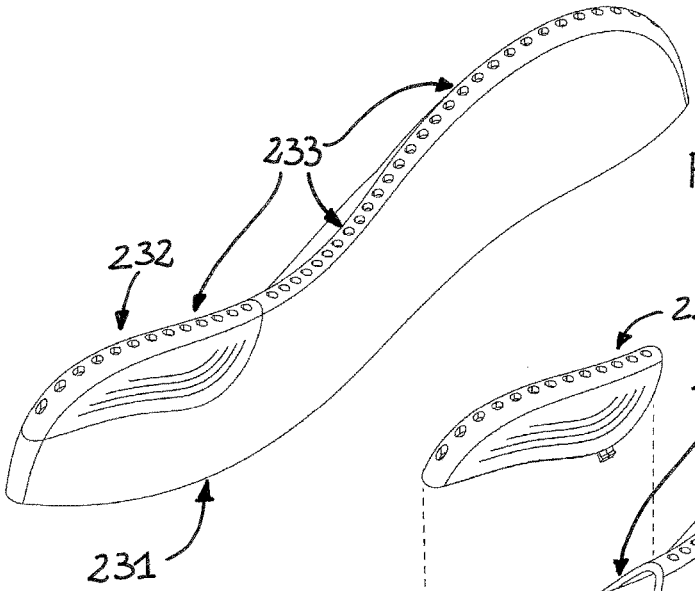
FIGS. 2 and 3 are perspective views, in different configurations, of a detail of the laundry-drying machine of FIG. 1.
Figure 3:
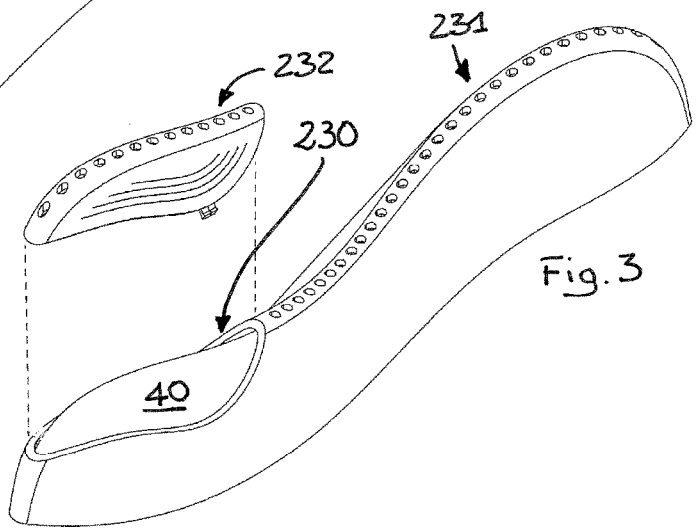

The laundry-agitation member 23 could be at least in part removable from the substantially cylindrical peripheral wall 22 of the drum 2, to facilitate access to the cavity 230 as shown in FIG. 2 and FIG. 3. In an embodiment not disclosed by the figures, the laundry-agitation member 23 could be wholly removed by the drum 2 (not shown). In a preferred solution (see for example FIG. 2) only a portion of the laundry-agitation member 23 is removable.

As further shown in FIG. 2 and FIG. 3 the laundry-agitation member 23 could comprise a base portion 231 connected to the substantially cylindrical peripheral wall 22 of the drum 2 and a removable portion 232 that is removably connectable with the base portion 231 to facilitate access to the cavity 230.

Advantageously the removable portion 232 is connectable to the base portion by at least one elastic tooth. In the embodiment disclosed in FIG. 2 the removable portion 232 affects only one extremity of the laundry-agitation member 23. In an alternative embodiment the removable portion 232 develops for the entire length of the laundry-agitation member 23.

The laundry-agitation member 23 comprises at least one hole 233 which puts the cavity 230 of the laundry-agitation member 23 in fluid communication with the interior of the drum 2 (i.e. with the laundry drying compartment 21). As shown in FIG. 2 and FIG. 3, the laundry-agitation member 23 comprises a plurality of holes 233 which put the cavity 230 in fluid communication with the interior of the drum 2.

The holes 233 are present on at least one of the base portion 231 or the removable portion 232 of the laundry-agitation member 23. As shown in FIG. 2 the holes develop along the entire length of the laundry-agitation member 23, along a single line.

The household laundry-drying machine 1 could comprise at least one spongy body 40 placed in the cavity 230.

The spongy body 40 is suitable for absorbing at least in part at least one of the substances to be delivered to the laundry drying compartment 21 during a drying cycle.

An object of the present invention is also to illustrate a method for drying laundry in a household laundry-drying machine 1. One or more steps of this method are advantageously implemented by a machine 1 having one or more of the features disclosed above. In particular the household laundry-drying machine 1 comprises a laundry drum 2 with a peripheral wall 22 to which at least one laundry-agitation member 23 is connected. The laundry drum 2 surrounds a laundry drying compartment 21.

The method comprises the step of dispensing in the laundry drying compartment 21 at least one substance previously placed in an internal cavity 230 of the laundry-agitation member 23, said substance being different from air. The step of dispensing the at least one substance comprises the step of vaporizing said substance.

Preferably the step of dispensing in the laundry drying compartment 21 at least one substance previously placed in an internal cavity 230 of the laundry-agitation member 23 comprises the step of generating steam from water placed internally to the cavity 230 of the laundry-agitation member 23. The steam is generated by heating the water in the cavity 230 using the heated drying air introduced in the drum 2. The drying air entering the drum 2 heats not only the laundry but also the drum 2. The steam helps to reduce wrinkles. Also the steam at least one of sanitizes laundry or refreshes clothes reducing bad odors.

The step of dispensing in the laundry drying compartment 21 at least one substance placed in an internal cavity 230 of the laundry-agitation member 23 may also comprise the step of dispensing a perfume emitted from said at least one substance placed in the internal cavity.

The invention as it is conceived enables multiple advantages to be attained.

In particular it enables the treatment of clothes with an additional substance that is gradually released without noise. Said additional substance may be freely chosen by the user. In particular it can sanitize laundry and/or eliminate bad odors (if any) and/or reduce wrinkles in the dried articles.

The invention as conceived is susceptible to numerous modification and variants, all falling within the scope of the inventive concept characterized thereby. Furthermore all the details can be replaced by other technically equivalent elements. In practice, all the materials used, as well as the dimensions, can be any according to requirements.

The invention claimed is:

1. A household laundry-drying machine comprising:

a drum rotatable about an axis of rotation and defining a laundry drying compartment, the drum having a peripheral wall which surrounds the laundry drying compartment;

an air heater;

a fan forcing air from the air heater to the laundry drying compartment; and a laundry-agitation member provided on the peripheral wall and having a body defining a cavity within an interior of the body and where the cavity is in fluid communication with the laundry drying compartment and wherein the cavity contains at least one substance to be delivered to the laundry drying compartment.

2. The household laundry-drying machine according to claim 1, wherein the cavity is in fluid communication with the outside of the drum only through the laundry drying compartment.

3. The household laundry-drying machine according to claim 1, wherein the laundry-agitation member is at least in part removable to facilitate access to the cavity.

4. The household laundry-drying machine according to claim 1, wherein the laundry-agitation member comprises:

a base portion connected to the peripheral wall of the drum; and a removable portion removably connectable with the base portion to facilitate access to the cavity.

5. The household laundry-drying machine according to claim 1, wherein the laundry-agitation member comprises a plurality of holes in fluid communication with an interior of the drum.

6. The household laundry-drying machine according to claim 1 comprising at least one spongy body placed in the cavity.

7. The household laundry-drying machine according to claim 1, wherein:

the drum comprises a front wall and a rear wall;

the peripheral wall extends in width between the front wall and the rear wall; and the laundry-agitation member extends for at least two thirds of the width of the peripheral wall.

8. The household laundry-drying machine according to claim 1, wherein the household laundry-drying machine is not suitable for washing laundry.

9. A method for drying laundry in a household laundry-drying machine comprising a drum having a laundry-agitation member, the method comprising dispensing, into the drum, at least one substance, from a cavity within an interior of a body of the laundry-agitation member where the cavity is in fluid communication with the drum and the cavity contains the at least one substance.

10. The method of claim 9, wherein the dispensing comprises vaporizing the at least one substance.

11. The method of claim 10, wherein the vaporizing comprises generating steam from the at least one substance.

12. The method of claim 9, wherein the dispensing comprises generating steam from the at least one substance.

13. The method of claim 9 wherein the at least one substance comprises a perfume.

* * * * *